US006116390A

United States Patent [19]

Cohen

[11] Patent Number: 6,116,390

[45] Date of Patent: Sep. 12, 2000

[54] WHEELED STACKABLE LUGGAGE

[76] Inventor: Fred E. Cohen, 2201 Banyan Dr., Los Angeles, Calif. 90049

[21] Appl. No.: 09/193,316

[22] Filed: Nov. 16, 1998

Related U.S. Application Data

[60] Provisional application No. 60/065,588, Nov. 18, 1997.

[51] Int. Cl.[7] ..... A45C 5/14; A45C 13/02; A45C 13/22; A45C 13/36

[52] U.S. Cl. ..... 190/18 A; 190/24; 190/115; 190/127

[58] Field of Search ..... 190/18 A, 15.1, 190/115, 24, 39, 127; 280/37

[56] References Cited

U.S. PATENT DOCUMENTS

| | | | |
|---|---|---|---|
| 1,149,266 | 8/1915 | Johnson | 190/18 A X |
| 1,400,509 | 12/1921 | Anthony et al. | 190/18 A X |
| 4,087,102 | 5/1978 | Sprague | 190/18 A X |
| 4,756,394 | 7/1988 | Cohen | 190/18 A |
| 4,890,705 | 1/1990 | Pineda | 190/18 A |
| 5,253,739 | 10/1993 | King | 190/18 A |
| 5,351,792 | 10/1994 | Cohen | 190/18 A |
| 5,374,073 | 12/1994 | Hung-Hsin | 190/18 A X |
| 5,377,795 | 1/1995 | Berman | 190/18 A |
| 5,407,039 | 4/1995 | Alper et al. | 190/18 A |
| 5,431,263 | 7/1995 | Nordstrom | 190/18 A |
| 5,497,865 | 3/1996 | Yun-Pi | 190/18 A X |
| 5,524,737 | 6/1996 | Wang | 190/18 A |
| 5,547,052 | 8/1996 | Latshaw | 190/15.1 X |
| 5,590,748 | 1/1997 | Chang | 190/18 A |
| 5,645,146 | 7/1997 | Bieber et al. | 190/127 X |
| 5,833,039 | 11/1998 | Kotkins, Jr. | 190/18 A X |

FOREIGN PATENT DOCUMENTS

| | | | |
|---|---|---|---|
| 2454773 | 12/1980 | France | 190/18 A |
| 2680647 | 3/1993 | France | 190/18 A |

*Primary Examiner*—Sue A. Weaver
*Attorney, Agent, or Firm*—Roger A. Marrs

[57] ABSTRACT

Wheeled luggage having a container of soft fabric adapted for stacking with other similar containers such as suitcases or the like. The container has at least three wheels mounted on the bottom to provide stability when rolled over a supporting surface. A selected pair of wheels extend beyond the rear periphery of the container so that the container may be pulled in a tilted position as well as pulled along on the wheels. The non-selected wheel is swiveled so that the suitcase may be easily maneuvered when it is pulled along the supporting surface in a non-tilted position. A handle device may be either a leash-type strap detachably connected to a connection at one end of the container and/or a rigid handle may be telescopically arranged on the container with or without a pivot. A pouch may be provided on the container for insertably receiving and storing the strap.

7 Claims, 2 Drawing Sheets

41
60
61
65
18
66
40
44
42
43
48
54
49
43'
55
56
45
47
42'
50
46
49'
58
51
53
52
19
45'
46'
47'
57
15

WHEELED STACKABLE LUGGAGE

Priority based on S/N 60-065,588 filed Nov. 18, 1997

BACKGROUND OF THE INVENTION

1. Field of the Invention

The present invention relates to the field of wheeled luggage, and more particularly to a novel form of luggage which incorporates wheels and handle means so that the luggage can accommodate a stack of other pieces of luggage and may be pulled along on four wheels or pulled in a slanted position on two wheels.

2. Brief Description of the Prior Art

In the past, it has been the conventional practice to employ a single piece of luggage which has wheels carried on one edge so that the luggage may be pulled along by a handle in a canted or slanted position. In other forms, the piece of luggage may include four wheels similar to a wheeled dolly wherein a pulling handle is provided for pulling the four-wheeled luggage from one place to another. While in this position, additional pieces of luggage may be placed on top of the wheeled luggage so that the additional luggage may be rollably transported as a unit with the wheeled luggage. Such an example of wheeled stackable luggage is disclosed in U.S. Pat. No. 5,351,792.

Although the prior attempts have been successful in stacking luggage on a wheeled arrangement, difficulties and problems have been encountered which stem largely from the fact that the four-wheeled luggage cannot be pulled along in a tilted or canted position since the wheels are mounted within the peripheral confines of the luggage itself. In other words, no wheels extend beyond the perimeter of the luggage so that the luggage can be canted or tilted during a pulling procedure. Furthermore, access to such conventional luggage is by means of a flap constituting a part of one side of the luggage so that when additional luggage is carried on top of that side, access is prevented to the interior of the bottommost luggage. Furthermore, such conventional luggage does not provide for a leash-type of pulling strap as well as a rigid telescoping handle so that convenience to the user is adversely affected.

Still a further disadvantage of conventional luggage of the four-wheeled form resides in the fact that rigid members, such as bumpers or corner guards, are required and are integrally formed with the soft material of the luggage, a labor intensive manufacturing procedure as well as removing many advantages attendant to the use of soft luggage. By providing end or corner pieces, the luggage no longer becomes as flexible and therefore greatly reduces the advantageous nature of flexible luggage.

Therefore, a long-standing need has existed to provide a novel form of wheeled stackable luggage which maintains the characteristics of flexible luggage and at the same time, provides for rigid platform or frame which is wheeled and may be readily assembled to soft luggage. Convenient access to the interior of the luggage while in a stackable condition is greatly advantageous and should be incorporated into a wheeled stackable luggage arrangement.

SUMMARY OF THE INVENTION

Accordingly, the above problems and difficulties are avoided by the present invention which provides a piece of wheeled luggage in the form of a container of soft fabric having a rectangular configuration so as to permit stacking with other similar containers such as suitcases or the like.

The container has at least three wheels mounted on the bottom at selective corners to provide stability when rolled over a supporting surface. A selected pair of wheels extend beyond the rear periphery of the container so that the container may be pulled in a slanted or tilted position on two wheels as well as pulled along on at least three wheels. Preferably, the non-selected wheels of the total number of wheels are swiveled so that the container may be easily maneuvered when it is pulled along the supporting surface.

Handle means are provided which may take the form of either a leash-type strap which is detachably connected to a connection at one end or side of the luggage container and/or a rigid handle may be telescopically arranged on the container,with or without a pivot, for pulling the luggage container along in a tilted or level position. The wheels may be carried in a framed assembly which is of rigid construction, having skids or rails into which the rigid handle may be slidably carried. The container of the luggage is composed of soft material and is attached to the wheeled frame so as to be a part thereof and form an integral and unitary construction. The user then has an option of pulling the stacked luggage on all wheels by means of the leash handle or the luggage container may be pulled along in a slanted or canted position on its rear wheels by means of the rigid handle in its extended position.

Therefore, it is among the primary objects of the present invention to provide a novel wheeled stackable luggage which may be pulled along in a four-wheeled support position with additional luggage stacked on top or that may be conveniently pulled along by an extended rigid handle in a tilted or canted position on its rear wheels.

Another object of the present invention is to provide a novel wheeled stackable luggage which is manufactured by employing a luggage container of soft material rigidly secured or attached to a wheeled rigid frame so that a unitary construction is produced whereby the assembled soft luggage container and rigid wheeled frame may be either pulled along on all four wheels or on the two rear wheels by handle means.

Still a further object of the present invention is to provide a novel wheeled stackable luggage container which includes rigid mounting for at least four wheels and which includes a variety of pockets, eyelets and strap storage means about its external sides and ends.

Yet another object resides in providing access to the wheeled stackable luggage container along the sides or ends of the container as opposed to sole entry through the top of the container.

Another object resides in providing a handle means for rollable luggage that is rigid and may include a pivoted section so that the user may more conveniently pull the luggage along a level surface on all of its wheels.

Furthermore, the handle means may be a flexible strap detachably connected to the container or luggage which is provided with a storage pouch or pocket.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figures 1, 2, 3:
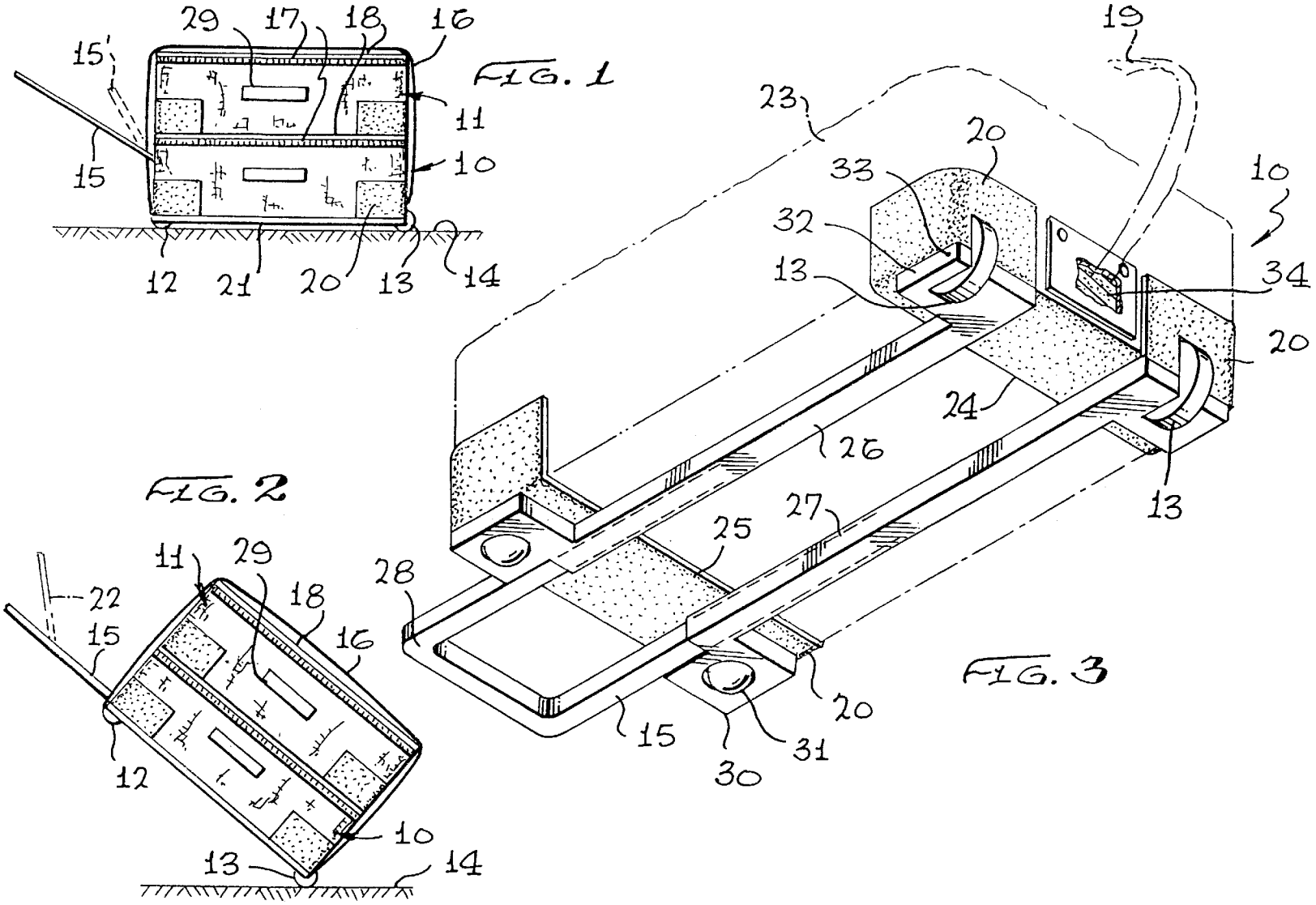
FIG. 1 is a diagrammatic view of wheeled stackable luggage having a piece of luggage carried on top of another so that the combined luggage containers can be pulled along a supporting surface by means of a leash-type strap.
FIG. 2 is a view similar to the view of FIG. 1 illustrating the combined luggage containers shown in FIG. 1 being pulled along a supporting surface on the rear wheels of the bottom luggage container and incorporating an extendable rigid handle.
FIG. 3 is a bottom view, in perspective, of the luggage container incorporating the present invention by assembling the soft container with the rigid wheel frame into a unitary construction.

Referring to FIG. 1, a diagrammatic illustrations is presented showing a wheeled luggage container 10 having a second luggage container 11 stacked on top. It is understood that even further stacking of luggage containers is anticipated as shown in broken lines. The luggage containers are of the same size and shape so as to be readily stackable or nested on top of one another. It can be seen that the bottom luggage container 10 includes a front wheel set 12 having a pair of swiveled wheels and a rear wheel set 13 comprising a pair of rollers adapted to rotate about a central axis. When the luggage containers are stacked, they may be pulled or transported along a surface 14 by pulling utilizing a handle means which may take the form of a rigid telescoping type handle 15 or which may be of a flexible strap or leash type handle 15'. The handle means will be described in greater detail further on. Also, in order to maintain the luggage containers in a stacked position, a hold-down strap 16 may be employed which has its opposite ends detachably connected to retaining or holding means located at opposite ends of the luggage container 10.

It is to be particularly noted that the luggage containers 10 and 11 are composed of a soft pliable material and is considered soft luggage. Access is gained to either of the luggage containers by means of a zipper closure, such as closure 17 which is arranged along the peripheral side and end edges immediately adjacent to a top side 18 which is void of any access closures or flaps. Therefore, should the user of the luggage containers desire to gain entrance while they are stacked, the zipper fastener 17 may be activated so that the top 18 can be raised.

Also, it is to be noted that the respective corners of the square soft luggage containers 10 and 11 are provided with rigid corners such as corner 20 that not only protects the corners of the soft fabric luggage container but serve to rigidize the bottom of each container. The respective rigid corners 20 are held together to form a frame for holding and supporting the respective luggage container by means of rails or skids 21 that extend across the bottom of each luggage container between its opposite ends. To accommodate handling of individual luggage containers, a hand grip handle is indicated by numeral 29.

Referring now in detail to FIG. 2, it can be seen that an alternate transportation procedure is provided by the present invention wherein the rear pair of wheels 13 can support one end of the stack while the front end or opposite end of the stacked luggage containers is raised or canted or tilted so that the rigid hand grip 15 can be grasped by the user. In this configuration of travel, the front set of wheels 12 are raised and do not support the luggage container stack. Furthermore, the rigid handle 15 may be readily pulled from its storage position along the bottom of the container and, if desired, the rigid handle 15 may be segmented so that a portion 22 of the handle means may be pivoted with respect to the major length of the handle. When operated in the position shown in broken lines, the user grasps the pivoted portion 22 of the handle and may adjust the tilt or slant of the luggage container stack accordingly. In actual practice, the front and rear wheel sets may even fully support the luggage container stack on surface 14 while the rigid handle means is pulled or extended outwardly with the front portion 22 pivoted in an upward position. The length of the upper portion 22 is sufficient so that the user may stand upright and walk forwardly while pulling the stack with the front and rear wheel sets on the surface 14.

Referring now to FIG. 3, luggage container 10 is illustrated and it can be that the soft luggage container, indicated by numeral 23, is carried on a unitary frame which is elongated and terminating in opposite ends 24 and 25. The ends 24 and 25 are joined together by means of skids or rails 26 and 27 which are hollow and may slidably or telescopingly accommodate the handle means such as the rigid handle 15. Preferably, the handle comprises a pair of parallel members which are slidably disposed within the hollow interior of each rail 26 and 27 and the members are joined by an end piece 28 which is intended to be grasped by the hand of the user. The respective corners 20 are integrally formed with the end pieces 24 and 25 so that an integral construction is produced along with the rails 26 and 27. It is to be particularly noted that the front end includes a mounting means for the pair of swivel wheels 12 and the mount is indicated by numeral 30 while a swivel wheel of the ball type is indicated by numeral 31. With respect to the rear wheel set 13, each wheel of the pair is held on a rear mount, such as mount 32, by means of a pivot or axle 33. Therefore, the frame comprising end pieces 24 and 25 as well as the parallel skids or rails 26 and 27 along with corners 20 can be formed or produced as a single piece unitary construction to which the soft luggage container 23 may be attached by any suitable means such as bolts, rivets or the like. Such construction permits the luggage containers to be stacked and pulled along as previously described with respect to FIGS. 1 and 2. The skids or rails are combined with the handle members so so that the handle may be stored within the skids or rails and a hold-down strap 19 may be joined to the opposite ends of the luggage container by providing snap clips on strap 19 which releasably secure with a loop or eyelet 34 carried on each end of the luggage container.

Figures 4, 5, 6:
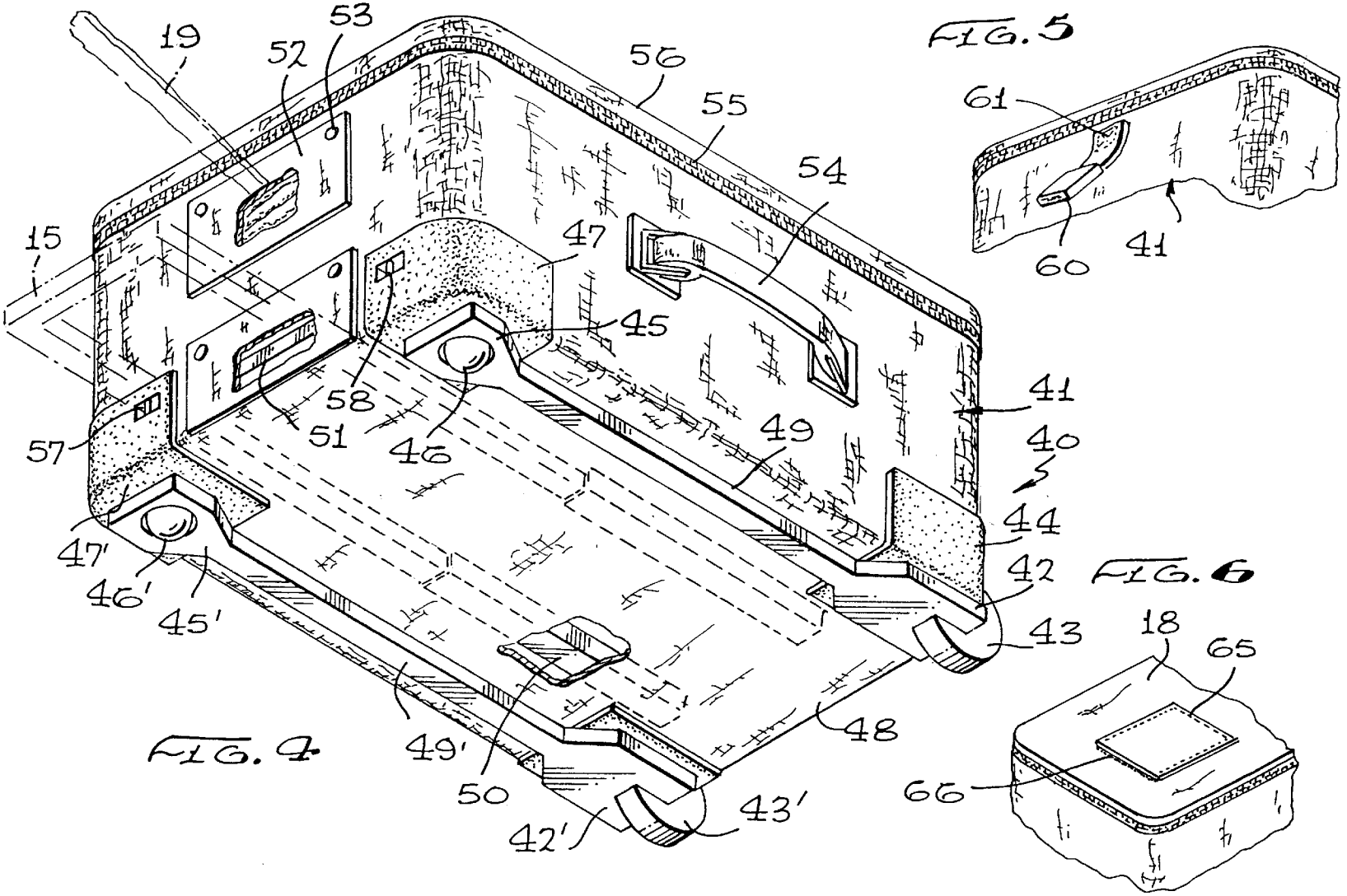
FIG. 4 is a bottom view, in perspective, of another version of the present invention, a wheeled stackable luggage container having a plurality of convenience features including eyelets, straps and telescoping handles, as well as mounting means for the four wheels attached to the underside of the container.
FIG. 5 is a perspective view of an auxiliary holding strap carried on one end of the luggage container.
FIG. 6 is a reduced fragmentary view of a storage pouch or pocket on the top of the luggage container for insertably receiving and storing of a flexible leash or strap.

Referring now to FIG. 4, another version of the invention is illustrated in the general direction of arrow 40 which includes a soft container 41 mounted on a pair of frames. Each frame of the pair includes an elongated skid or rail 49, having its opposite ends terminating in a rear mount 42 for rollably carrying a wheel 43 and a rigid corner or bumper protector 44. The front end of the rail or skid 49 includes a mounting 45 for a swivel ball 46 and a corner protector or bumper 47. The second rail is indicated by similar numbers marked with a prime. A rigid base or panel 48 may support the underside of the container 41 as well as support the pair of frames 41 and 41'. Underneath the panel 48, it can be seen that a pair of tubular or hollow members, such as member 50, are disposed so as to slidably receive the handle means 15 such as that shown with respect to FIG. 3. The handle means may be articulated as shown in FIG. 2 in broken lines by numeral 22 or may be pulled or extended outwardly into the solid line position as shown in FIG. 2 by numeral 15.

The opposite ends of the container 41 include eyelets or attachment bars, such as bar 51, to which the snaps of the hold-down strap 19 may be attached. Also, the end of the luggage container 41 may include an interior pocket covered by flap 52 intended to store the strap 18 when not in use. The flap is held closed by means of snaps 53.

A hand grip or handle 54 is carried on the side of the luggage container 41 in a similar fashion as previously described with respect to FIG. 1. Also, entrance into the interior of the container 41 is via the opening of a zipper closure 55 so that a top panel or lid 56 can be lifted so that the user can gain access to the interior.

It should also be noted that a primary feature of the present invention is the provision of placing the rear set of wheels 13 in either of the embodiments shown in FIGS. 3 or 4 at the rear of the container so that the individual wheels outwardly project from the rear end of the container as well as downwardly from the underside of the container. The placement of the rear set of wheels in this construction permits the stack of luggage containers to assume the tilted or canted position, as shown in FIG. 2. Should the wheels be placed solely on the bottom of the luggage container, as is the case with the front set of wheels, then the stack could not be transported or pulled along in the canted or tilted position. Also, either version of the present invention may include, as shown in connection with the bumpers 47 and 47' in FIG. 4, a pair of connectors 57 and 58 that may detachably connect with the ends of a pulling strap which may be the strap 19 that may have an alternate use as a hold-down strap or as a pulling strap. If desired, a separate additional strap may be stored in the pocket under flap 52 which would be a pulling strap in addition to the pull-down strap. The opposite ends of the pulling strap would include snap fasteners that can be detachably connected with the eyelets 57 and 58 and in this condition, the pulling strap becomes a pulling handle in the same fashion as handle 15. Therefore, the user would have the option of pulling the stack of luggage containers via the rigid handle 15 or the alternate pulling strap.

In FIG. 5, the end of the container 41 may include, if desired, a snap fastener 60 into which one end of the hold-down strap can be buckled. The fastener 60 is fixedly secured to the end of the luggage container by means of stitching 61 and the hold-down strap 16 may be fixedly attached to the opposite end of the container and carry the other end of a buckle which would fit with buckle 60.

In view of the foregoing, it can be seen that the novel luggage of the present invention provides a luggage container which may be rolled on the front and rear sets of wheels, as shown in FIG. 1, or alternately, the stack of luggage containers may be rolled on the rear set of wheels 13, as shown in FIG. 2. The pulling means or handle means may take the form of a strap having its opposite ends detachably coupled with eyelets 57 and 58 or by means of a rigid handle which is stored within the rails or skids 26 and 27 illustrated in FIG. 3 or the tubular members 50 shown in FIG. 4.

FIG. 6 illustrates the provision for storage of the leash-type strap in a pouch or pocket 65 carried on the top 18 of the luggage container. The pouch or pocket includes a hook-and-pile or zippered closure 66 for closing an entrance leading into the interior thereof.

Furthermore, it is understood that a single swivel wheel may be used at one end of the luggage container rather than a set of swivel wheels. Therefore, the invention includes at least three wheels., two of which are fixed and at least one is a swivel wheel.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A piece of rollable luggage comprising:

a container of a rectangular configuration with four corners and having a flat top composed of a soft fabric material, a flat bottom and four flat sides;

a rigid frame secured to said flat bottom;

wheels mounted on said frame and extending downwardly from said bottom with selected pairs of wheels rollably mounted on said four corners of said container;

said sides include a continuous edge defining an entrance to said container wherein said top constitutes a flap permitting access to the interior of said container;

a closure means carried on said continuous edge for closing and opening said entrance;

handle means carried on said container for transporting said container from place to place;

said luggage container accommodates stacking of other ones of said containers with said bottom of one container engageable with said top of an adjacent container;

said handle means adapted to transport said stacked containers as a unit via a selected pair of said wheels on the lowermost container of the stack;

a handle storage pocket carried on said top flap of said container having an open entrance; and said handle means is a flexible strap storable in said pocket.

2. The piece of luggage defined in claim 1 wherein:

said handle means further includes a rigid handle slidably carried on said frame having an extended position and a storage position.

3. The piece of luggage defined in claim 2 wherein:

said rigid handle having a first portion slidably carried on said container and a second portion pivotally connected to said first portion operable to be pivoted when said rigid handle is in its operative position.

4. A piece of rollable luggage comprising:

a container having opposite sides joining at one end and with an opposite other end with a top flap and a bottom that is opposite from said top flap so as to define an internal luggage compartment;

a frame carried on said container adjacent to said bottom and having at least one holder extending across said bottom between said one end and said opposite end;

wheels operably disposed on said frame to rollably support said container;

handle means slidably carried on said holder and being extendable and retractable between an operative position and a storage position respectively;

said holder having an elongated receptacle for slidably mounting said handle means;

said handle means include a pair of elongated parallel and spaced-apart members joined by a cross member;

said members slidably mounted in said receptacle of said holder;

said frame including a pair of rails with mounting blocks disposed on opposite ends thereof; and said wheels include a pair of non-swivelling wheels supported on said mounting blocks adjacent to said one end of said container and a pair of swivel wheels supported on said mounting blocks adjacent to said opposite end of said containers.

5. The rollable luggage defined in claim 4 wherein:

said handle means further includes a storage pocket provided on said container and a flexible strap detachably connected to said container and insertably receivable in said storage pocket when detached from said container.

6. The rollable luggage defined in claim 5 wherein:

said pair of rails includes an exposed exterior surface constituting skids for slidably supporting said container.

7. A piece of rollable luggage comprising:

a container of a rectangular configuration with four corners and having a flat top composed of a soft fabric material, a flat bottom and four flat sides;

a rigid frame secured to said flat bottom;

wheels mounted on said frame and extending downwardly from said bottom with selected pairs of wheels rollably mounted on said four corners of said container;

said sides include a continuous edge defining an entrance to said container wherein said top constitutes a flap permitting access to the interior of said container;

a closure means carried on said continuous edge for closing and opening said entrance;

handle means carried on said container for transporting said container from place to place;

said luggage container accommodates stacking of other ones of said containers with said bottom of one container engageable with said top of an adjacent container;

said handle means adapted to transport said stacked containers as a unit via a selected pair of said wheels on the lowermost container of the stack;

said handle means further includes a rigid handle slidably carried on said frame having an extended position and a storage position; and said rigid handle having a first portion slidably carried on said container and a second portion pivotally connected to said first portion operable to be pivoted when said rigid handle is in its operative position.

* * * * *